United States Patent [19]

Polotti

[11] Patent Number: 4,667,359

[45] Date of Patent: May 26, 1987

[54] UNIVERSAL GRIP DEVICE PARTICULARLY FOR GENERIC BOTTLES AND THE LIKE CONTAINER

[76] Inventor: Enzo Polotti, Via Pasubio 2, Brescia, Italy

[21] Appl. No.: 814,950

[22] Filed: Dec. 31, 1985

[30] Foreign Application Priority Data

Jan. 15, 1985 [IT] Italy ..... 19107 A/85

[51] Int. Cl.[4] ..... B67B 7/44

[52] U.S. Cl. ..... 7/151; 81/3.09; 81/3.4

[58] Field of Search ..... 7/151; 81/3.09, 3.15, 81/3.4, 3.07, 3.36; 294/28, 30, 31.2, 33

[56] References Cited

U.S. PATENT DOCUMENTS 965,629 7/1910 Holz ..... 294/28
1,004,734 10/1911 Bettis ..... 81/3.4
2,208,478 7/1940 Simons et al. ..... 81/3.09
2,308,744 1/1943 Bugs ..... 294/28
3,688,936 9/1972 Killigrew, Jr. ..... 294/33
3,794,370 2/1974 Lockhart et al. ..... 294/31.2

FOREIGN PATENT DOCUMENTS 911277 11/1962 United Kingdom ..... 294/31.2

*Primary Examiner*—Roscoe V. Parker
*Attorney, Agent, or Firm*—Guido Modiano; Albert Josif

[57] ABSTRACT

The universal grip device comprises a handgrip element provided, at one end thereof, with an engagement body which can be snap fitted onto the neck portion of a bottle. With the handgrip element there is associated, at the other end, a band element which is clampable ring-like and engageable with a portion of the lateral surface of said bottle.

4 Claims, 6 Drawing Figures

4
2b
1
2
2a
23
23
20
40
3a
3

40
4
1
2
20
3

40
4
2b
1
3
20
2
2a
23
23
30
31
11
10

20
4
1
10

20
4
10
23
4
23
21
22

2
1
22
21
23
23
40
4
3

UNIVERSAL GRIP DEVICE PARTICULARLY FOR GENERIC BOTTLES AND THE LIKE CONTAINER

BACKGROUND OF THE INVENTION

This invention relates to a universal grip device particularly for bottles and the like containers.

As is known, already marketed are grip devices which are applicable to bottles. Such grip devices, in their commonest of embodiments, comprise a bottom washer which engages below the bottle bottom and is connected to a handgrip element which may be hooked on at the bottle neck.

Such types of grip device must be currently manufactured in sizes and dimensions that exactly fit a bottle whereto they are to be applied, so that they have a very limited range of applicability because, in theory, one is to provide a different grip design for each bottle.

Another drawback of the prior solutions is that the aforesaid prior grip devices have in general a complex construction and are inconvenient to use in that they engage with the bottle bottom, for which reason they become notably bulky.

SUMMARY OF THE INVENTION

It is the aim of this invention to obviate the cited prior drawbacks by providing a universal grip device of novel type which is applicable to a wide range of bottles, and automatically adaptable to the dimensions of a bottle whereto it is to be applied.

Within the above aim, it is a particular object of the invention to provide a universal grip device which is particularly useful, above all where applied to plastic bottles currently in widespread use for packaging gaseous drinks or beverages and the like, it affording the possibility of holding the bottle itself firmly without the risk of the bottle being deformed, as is to be experienced at present on grasping the bottle.

Another object of the invention is to provide a universal grip device which can be reduced to a compact size when not being used, thus affording increased convenience and reducing storage and packaging bulk.

A further object of this invention is to provide a universal grip device which, owing to its peculiar construction, can give full assurance of being reliable and safe to use.

A not least object of the invention is to provide a universal grip device which can also be used as a seal opener for removing the caps from bottles containing gaseous drinks or the like, and which is competitive from a purely economical standpoint.

The above aim, and these and other objects to be apparent hereinafter, are achieved by a universal grip device particularly for application to generic bottles and the like containers, according to the invention, characterized in that it comprises a handgrip element provided, at one of its ends, with an engagement body adapted for removably engaging the neck portion of a bottle, with said handgrip element there being associated, at the other of its ends, a band element adapted for assuming a ring-like configuration and being removably engageable with a lateral portion of said bottle.

BRIEF DESCRIPTION OF THE DRAWINGS

Further features and advantages will become apparent from the following description of a preferred embodiment of a universal grip device particularly for application to generic bottles and the like con- tainers, with reference to the accompanying illustrative drawing, where.

DESCRIPTION OF THE PREFERRED EMBODIMENTS

Figures 1, 2, 3, 4, 5, 6:
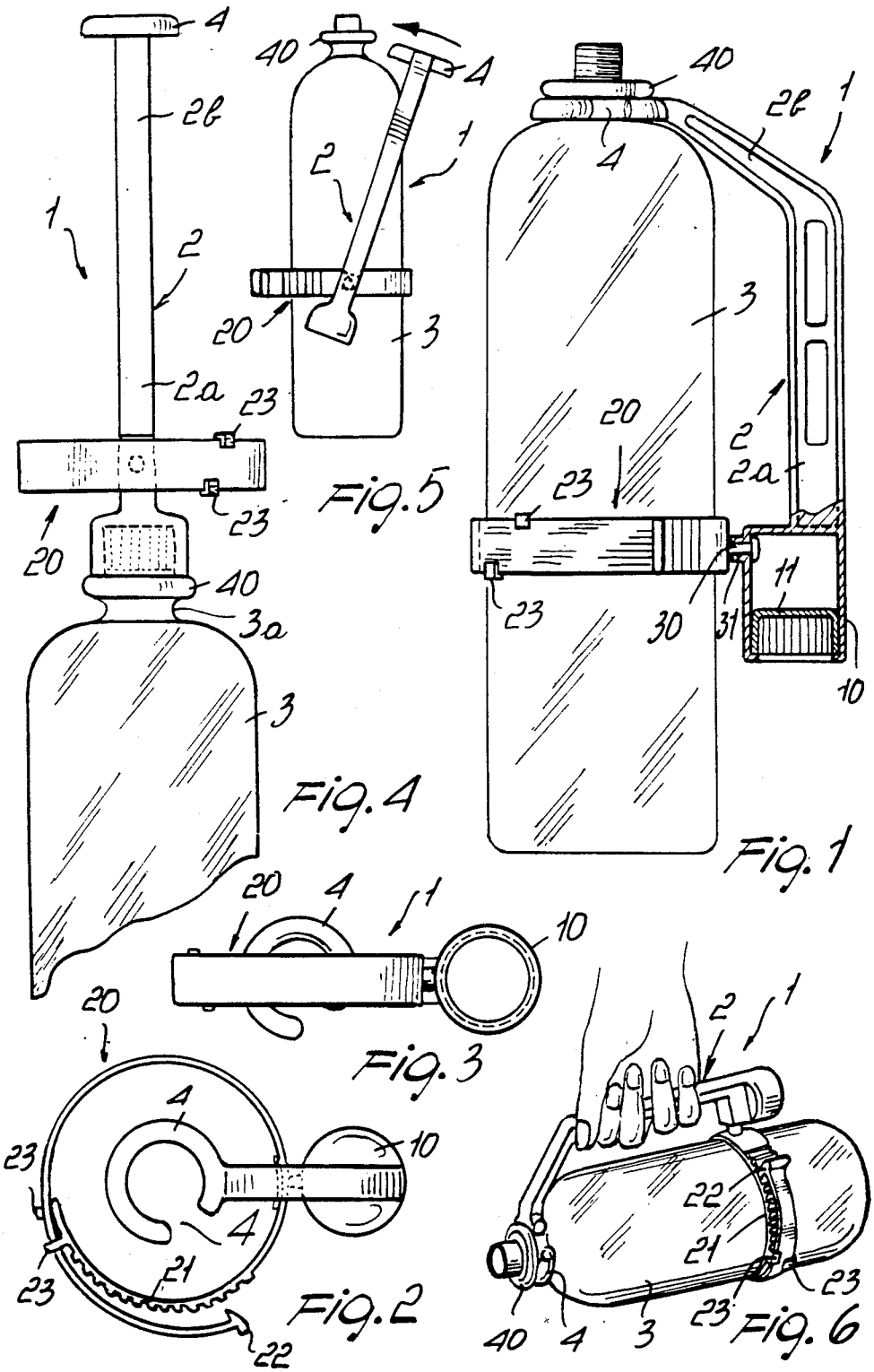
FIG. 1 is a partly sectional schematic view of the universal grip device of this invention as applied to a bottle.
FIG. 2 is a top plan view of the universal grip device.
FIG. 3 shows the universal grip device in plan view as positioned to reduce its bulk, when not in use.
FIG. 4 is a schematic view showing the universal grip device as used as a seal opener.
FIG. 5 shows diagrammatically the application of the universal grip device to a bottle.
FIG. 6 is a perspective view showing diagrammatically the use of the universal grip device according to the invention.

With reference to the cited drawing figures, the universal grip device particularly for application to generic bottles and the like containers, according to the invention, as generally indicated by the reference numeral 1, has a handgrip element 2 which advantageously has an elongate shape with a rectilinear section **2*a* merging with an inclined section 2*b* which ends in an engagement body adapted for removably engaging the neck portion of a bottle 3**.

The cited engagement body comprises a ring, expediently a partially open elastic ring or split ring, indicated at 4, which may be snap fitted onto the neck portion **3*a* of the bottle 3**.

As visible in particular from FIG. 2, the aperture 4 of the split ring 4 faces in a direction transverse to the plane in which the handgrip 2 lies.

At the bottom end of the handgrip element 2, that is at the end thereof remote from the split ring 4, there is provided a seal opener for removing screw-on caps of generic bottles and the like containers, which comprises advantageously a body 10 on the inside whereof there is provided recess or cup 11, having a scored or roughened surface or surfaces which is accessible from the bottom part of the handgrip element insertable therein, and which, as shown in FIG. 4, is applicable to the cap to be opened to aid the user in the bottle opening operation and particularly during the rotation step required to break the cap seals.

With the handgrip element 2, at said bottom end thereof, there is associated a band element, generally indicated at 20, which is adapted for being clamped into a ring-like conformation.

More precisely, as clearly shown for example in FIG. 2, the band element 20 has, at one of its ends a closure zone 21, provided with projecting teeth, wherewith a dog 22, provided at the other end of the band element 20, is engageable.

The dog 22 and projecting teeth 21 are shaped to allow radial contraction of the band element 20, while preventing, however, its accidental expansion which can only be obtained by disengaging the dog 22.

It should be added to the foregoing that at one end of the band element 20 there are formed lugs or straps, indicated at 23, which are adapted to be wound over each other to allow the band element 20 to assume the desired ring-like shape.

The cited band element, once formed into a ring, is engageable, and here is a peculiar feature of the invention, with a portion of the lateral or cylindrical surface of the bottle 3.

The band element 20 is coupled with the handgrip element 2 through an axial pin or pivot 30, accommodated in a supporting formation in the form of a sleeve 31 provided on the cup 11 for rotation about a substantially radial axis with respect to the band element itself, thereby as visible in FIG. 1 the axis of the pivot 30 lies both in the plane defined by the ring-like shape assumed by the band element 20 and in the plane in which the handgrip element lies, so that, when the universal grip device is not in use, the band element can be rotated and folded to extend in a substantially coplanar direction with respect to the handgrip element 2, whereas with the grip device in use, the band element is rotated about the axis of the pin 30 to lay on a substantially perpendicular plane to the longitudinal extent of the handgrip 2.

The use of the grip device according to the invention, is extremely simple, in fact to carry out its application to the bottle it is sufficient to disengage the dog 22 from the teeth 21 and to wrap the band element 20 circumferentially around the bottle itself positioning it on the lateral surface.

The band element, once positioned on the bottle, can be constricted to engage therewith owing to the inherent elasticity of the band element, or be alternatively clamped manually such that it embraces firmly the outer lateral surface of the bottle.

After positioning the band element the snap fitting of the split ring 4 onto the portion 3*a* below the bottle neck is carried out such that the bottle is supported, at two spaced apart points and precisely a point provided at the bottle neck, preferably below the enlarged portion, indicated at 40, which is typically formed on plastic bottles and at a point which is provided on a middle portion of the bottle lateral surface.

The handgrip element, with the universal grip device applied to the bottle, extends laterally of the bottle itself and provides a convenient grip element for facilitating pouring out the bottle's contents, as shown schematically in FIG. 6.

Another important peculiarity of the invention is that the band element 20 by being connected to the handgrip element for rotation by the engagement of the peg or pin 30, defined radially on the band element, into the hole or sleeve 31 defined on the body 10 of the handgrip 2 can be positioned, to reduce the bulk dimensions when not in use.

The invention herein is susceptible to many modifications and changes without departing from the inventive concept.

Furthermore, all the details may be replaced with other technically equivalent elements.

In practicing the invention, the materials used and the dimensions and contingent shapes may be any ones meeting individual requirements.

I claim:

1. A universal grip device particularly for bottle-like containers with a cylindrical body portion and a neck formation at one end thereof, the device comprising:

A handgrip element having an elongate handle like shape extending in a first plane and having a first free end and an opposite second free end thereof longitudinally at a distance from said first free end, a split ring formation on said first free end for snap engagement with the neck formation of the bottle-like container, a supporting formation on said second free end, a band element adapted to encircle the cylindrical body portion of the container and having closure means for maintaining a ring-like configuration defining a second plane of the band element, pivot means for pivotally connecting said band element to said supporting formation, said pivot means defining a pivot axis lying both in said first plane and in said second plane thereby allowing said band element and said handgrip element to assume relative angular positions ranging from a relative angular position in which said first and said second planes are parallel to each other up to a ralative angular position in which said first and said second planes are perpendicular to each other.

2. A device according to claim 1, wherein said split ring has said split thereof facing in a direction transverse to said first plane.

3. A device as claimed in claim 1, wherein said supporting formation includes an internally scored cup formation means for bottle opening operation.

4. A universal grip device particularly for bottle-like containers with a cylindrical body portion and a neck formation at one end thereof, the device comprising:

A handgrip element having an elongate handle like shape extending in a first plane and having a first free end and an opposite second free end thereof longitudinally at a distance from said first free end, a split ring formation on said first free end for snap engagement with the neck formation of the bottle-like container, a supporting formation on said second free end, a band element adapted to encircle the cylindrical body portion of the container and having closure means for maintaining a ring-like configuration defining a second plane of the band element, pivot means for pivotally connecting said band element to said supporting formation, said pivot means defining a pivot axis lying both in said first plane and in said second plane thereby allowing said band element and said handgrip element to assume relative angular positions ranging from a relative angular position in which said first and said second planes are parallel to each other up to a ralative angular position in which said first and said second planes are perpendicular to each other and wherein said split ring has said split thereof facing in a direction transverse to said first plane and wherein said supporting formation includes an internally scored cup formation means for bottle opening operation.

* * * * *